US005603193A

United States Patent [19]

Koertge et al.

[11] Patent Number: 5,603,193

[45] Date of Patent: Feb. 18, 1997

[54] SEALING SYSTEM FOR MULTI-PANEL CEILING

[76] Inventors: Richard J. Koertge; Eric D. Koertge, both of 60 Meander Pk., Chatham, Ill. 62629

[21] Appl. No.: 540,986

[22] Filed: Oct. 11, 1995

[51] Int. Cl.[6] ..... E04B 5/52

[52] U.S. Cl. ..... 52/506.07; 52/489.2; 52/589.1

[58] Field of Search ..... 52/506.07, 589.1, 52/489.1, 489.2

[56] References Cited

U.S. PATENT DOCUMENTS

| | | | |
|---|---|---|---|
| 3,207,057 | 9/1965 | Brown et al. . | |
| 3,565,473 | 2/1971 | Kedel . | |
| 3,889,435 | 6/1975 | Ollinger . | |
| 4,027,454 | 6/1977 | Schuplin . | |
| 4,033,079 | 7/1977 | Cross . | |
| 4,062,164 | 12/1977 | Cousins . | |
| 4,191,352 | 3/1980 | Schuplin | 52/506.07 X |
| 4,580,387 | 4/1986 | Rogers | 52/506.07 X |
| 4,599,831 | 7/1986 | Magaha, Jr. | 52/506.07 X |
| 4,619,086 | 10/1986 | Naka | 52/506.07 X |
| 4,858,408 | 8/1989 | Dunn . | |
| 4,873,809 | 10/1989 | Paul . | |
| 4,926,606 | 5/1990 | Hanson | 52/506.07 |
| 4,937,994 | 7/1990 | Ritter | 52/506.07 |
| 4,967,530 | 11/1990 | Clunn . | |
| 5,024,034 | 6/1991 | Gailey | 52/506.07 X |

*Primary Examiner*—Wynn E. Wood
*Attorney, Agent, or Firm*—Robbins & Robbins

[57] ABSTRACT

A sealing system for a multi-panel T-bar ceiling. The panels are supported upon arms of the T-bar supports and a locking system is used for sealing the peripheral edges of the panels upon the arms of the T-bar. The sealing is in compressive relation of the panels upon the arms against upward forces that might tend to move the panels off the T-bar such as in cleaning operations and the like. The locking system is comprised of an operating rod, such as a screw or the like extending through the T-bar which can turn a threaded locking member, such as a clip or the like into forceful relation against the edge of the panel into sealing engagement against the arms of the T-bar. When sealed, only the head of the screw is visible from the bottom of the panel. A resilient seal may be employed between the panel and the arm of the T-bar. The clip may be in the form of an internally threaded elongated L-shaped member which bears laterally against the T-bar when the operating rod is rotated causing the clip to move against or away from the panel. The operating rod may be rotated such that the panel may be locked or unlocked. When unlocked, the panel may be removed for servicing as desired.

11 Claims, 5 Drawing Sheets

SEALING SYSTEM FOR MULTI-PANEL CEILING

BACKGROUND OF THE INVENTION

In the past multi-panel ceiling systems suspended in spaced relation from a rough unfinished ceiling or below a roof have been conventionally provided. The space between the multi-panel ceiling and the unfinished ceiling can vary from several inches to several feet, depending on the design of the building.

In such systems, a so-called T-bar grid system is conventionally employed. The T-bars are in the order of longitudinally extending rails with lateral arms extending from the bottom of an upstanding leg which may be supported from the unfinished ceiling by a wire, rods or the like.

Problems have been encountered in the past when upward forces are encountered by the panels, such as in normal cleaning, painting or the like. Such operations tend to dislodge the panels from their gravity support upon the T-bars causing problems in re-arrangement. Such cleaning may be required for various purposes in providing a hygienic room and may be by way of water sprays or jets by hoses or other cleaning operations.

While locking systems for the panels have been provided in the past, such as barbed members which lock the panels against the supporting T-bar, there has remained a need for easily and inexpensively locking the individual panels against a conventional T-bar while at the same time providing for easily unlocking the panels for removal, repair or servicing of wiring or equipment between the multi-panel ceiling and rough ceiling above.

SUMMARY OF THE INVENTION

By means of this invention there has been provided an improved sealing or hold down device for lay-in ceiling tiles employed in a T-bar supporting grid system. The sealing or hold down device is adapted to bear against and press down the edges of the ceiling tile against horizontal supporting legs of the T-bar to provide a clamping action to resist upward forces of one type or another such as those encountered in cleaning or washing the ceiling tiles.

The hold down device can be engaged or disengaged with the top surface of the panel by rotating an operating rod to effect the engagement and disengagement. The operating rod may be in the form of a screw, bolt or the like extending through the panel to an internally threaded locking member in the form of a clip which can be caused to move vertically to bear against a portion of the T-bar. In this feature only the head of the screw is visible on the underside of the panel which obviates the necessity of unsightly appurtenances and helps to present a clean and uncluttered bottom surface to the ceiling tiles.

The locking device is raised or lowered by turning the operating rod to cause engagement or disengagement with the T-bar. In the locking engagement the locking member is caused to press the supported edge of the panel against the supporting arm of the T-bar.

The locking device may be in the form of an elongated internally threaded clip. When the threaded operating rod is turned, the clip is prevented from rotating by close spacing to the leg of the T-bar which restrains the clip from, rotary movement. Thus, an up or down movement is effected for the clip by turning the operating rod.

The entire sealing and locking system can be simply provided for conventional lay-in ceiling tiles and supporting T-bar grid system. The installation, operation and maintenance can be effectively employed by relatively unskilled workmen at low cost and with effective results.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
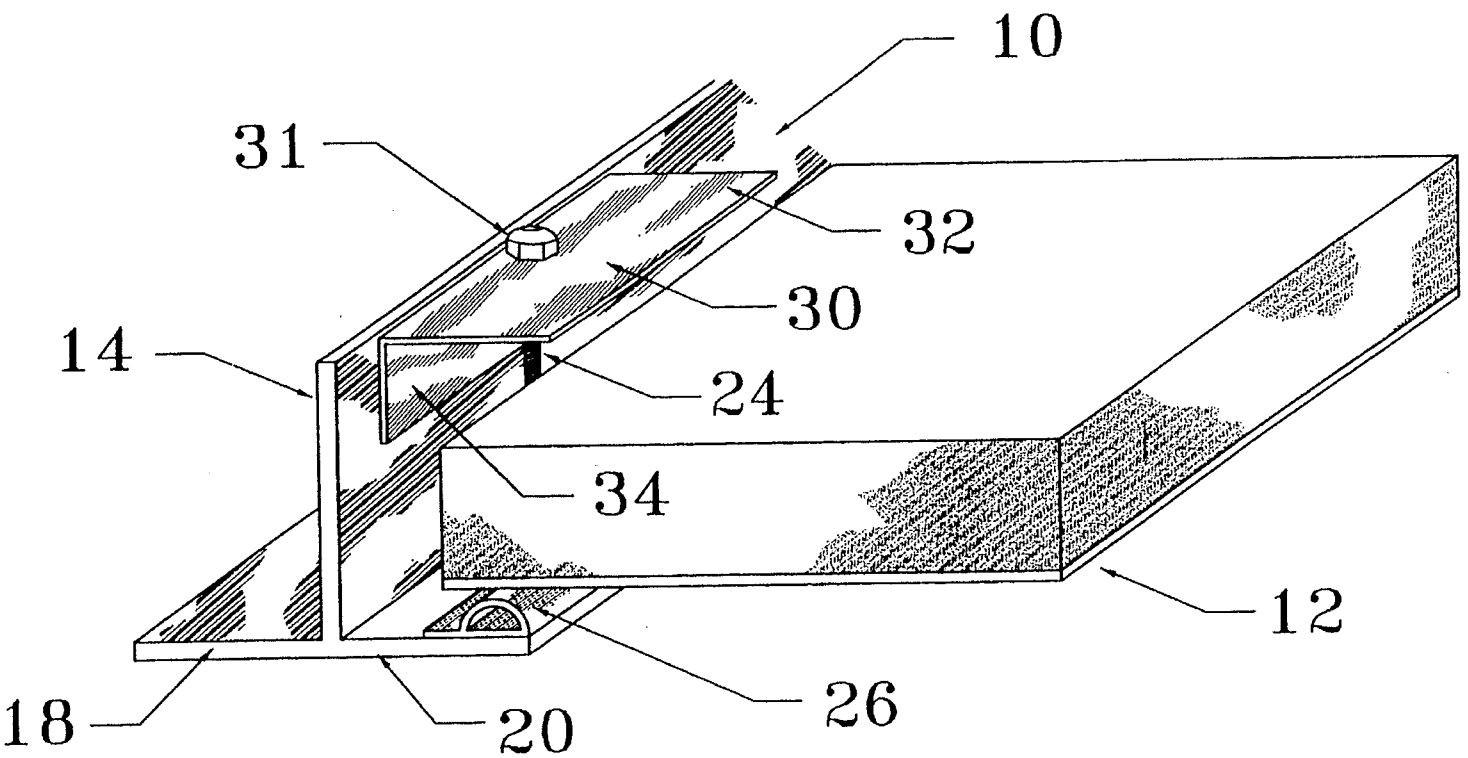
FIG. 1 is a perspective side view of the sealing system.
Figure 2:
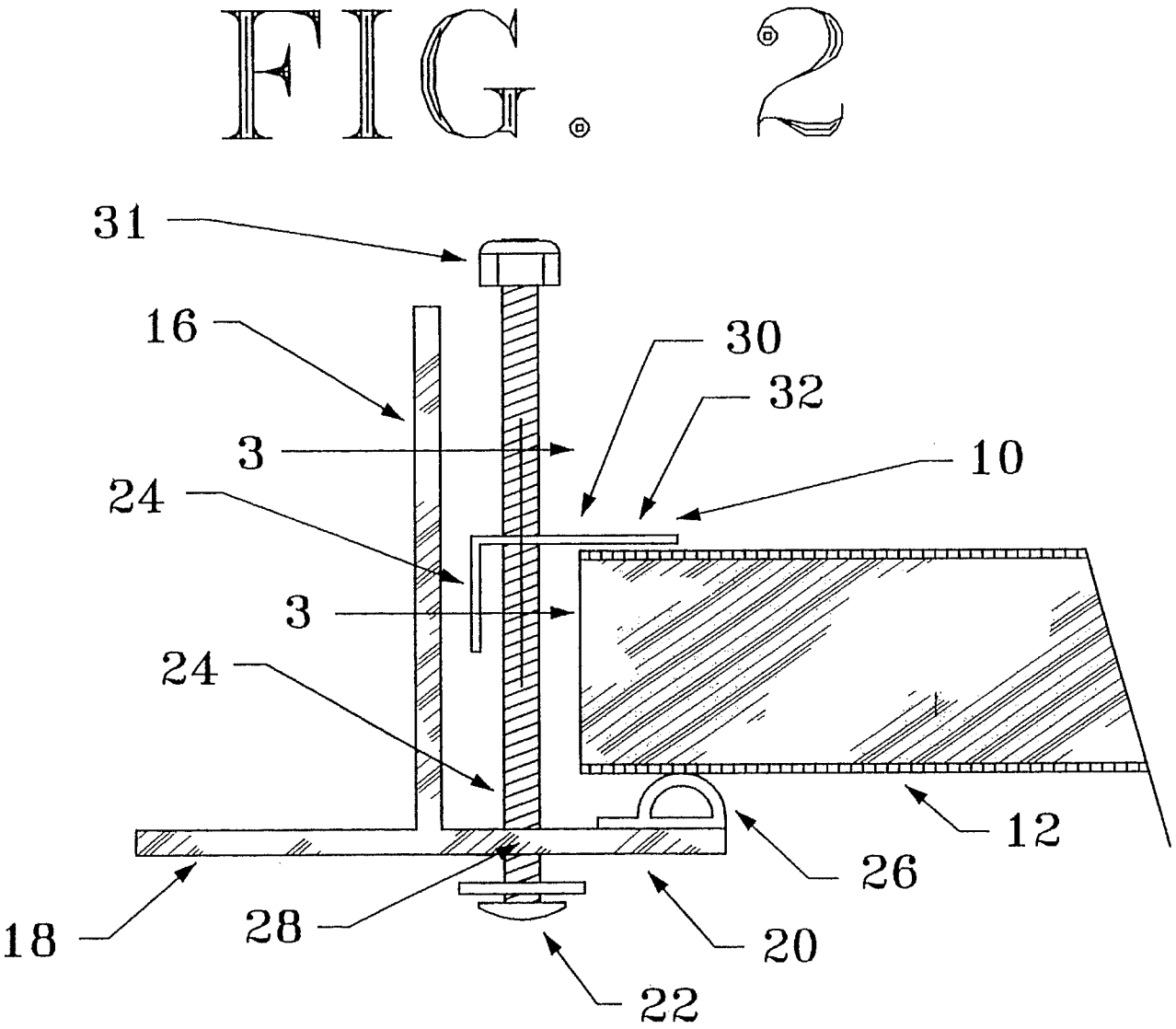
FIG. 2 is a view in side elevation showing the sealing system in clamped position.
Figure 3:
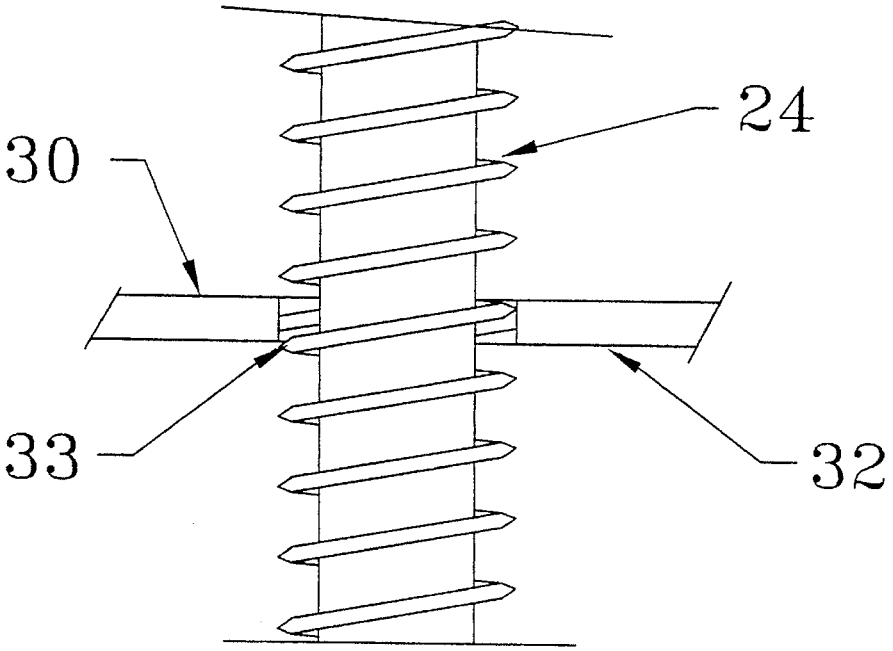
FIG. 3 is an enlarged view in section taken on line 3—3 of FIG. 2.
Figure 4:
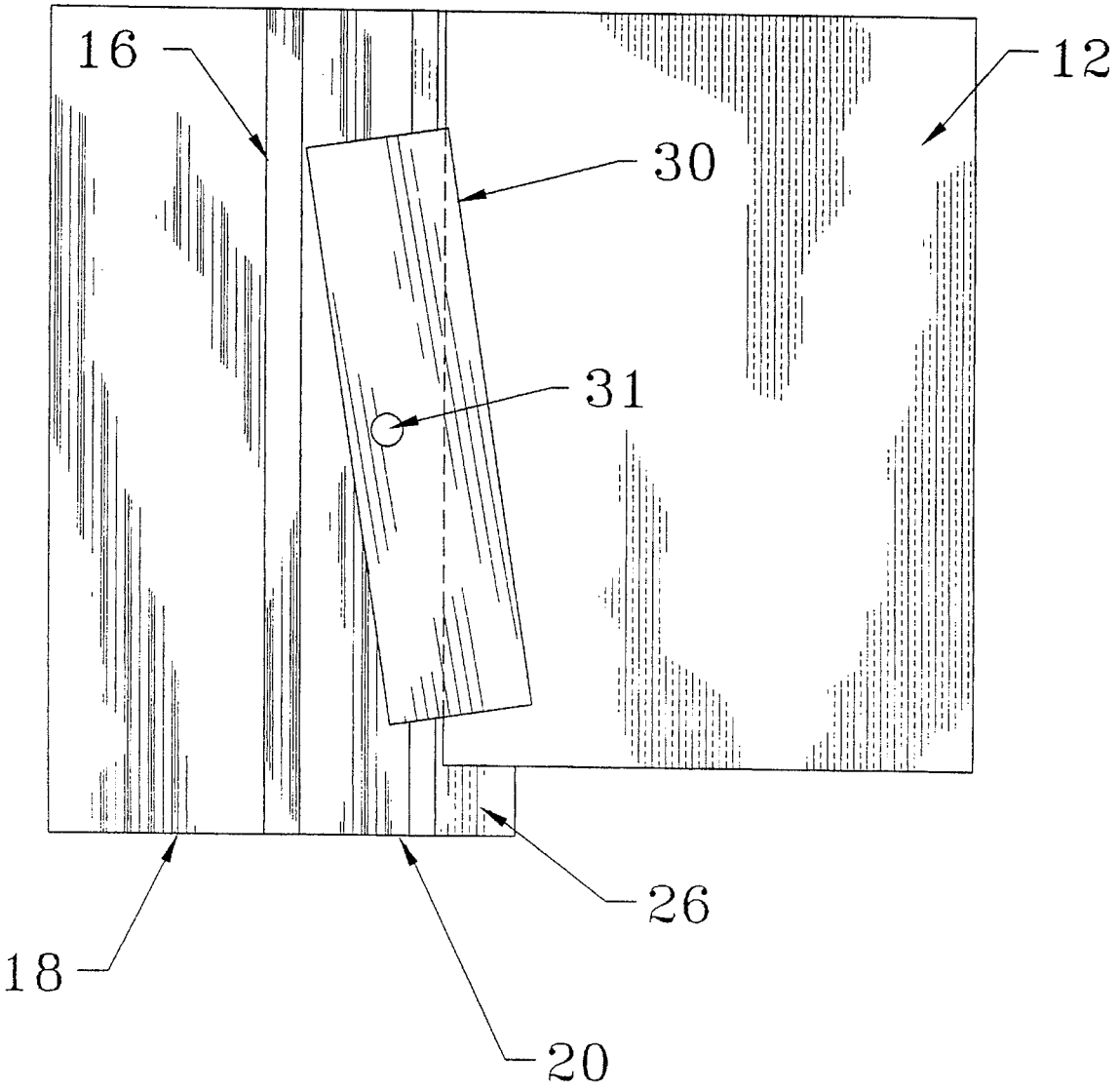
FIG. 4 is an enlarged fragmentary top plan view showing the locking member bearing against the T-bar in the locking mode.

The sealing system for a ceiling tile layout is generally indicted by the reference numeral 10. It is employed with conventional ceiling tiles 12 used with a T-bar support grid 14. The T-bar grid is of a conventional type employing an upstanding leg 16 and two lower support arms 18 and 20 for supporting the ceiling tiles 12. The T-bar grid 14 is suspended by wires, rods and the like from a ceiling support (not shown) above the T-bar grid in the usual fashion as will be well understood in the art.

The sealing system 10 is designed to be unobtrusive in appearance so as not to mar the aesthetics of the ceiling. Only a head 22 of an operating rod 24 for locking and unlocking the ceiling tile to the T-bar grid is visible to an observer below the ceiling. A plastic foam strip 26 having one side adhesive is fitted on an arm of the T-bar to support the edge of the ceiling panel 12 and enhance the sealing of the panel to the T-bar grid when the sealing system is engaged.

The operating rod 24 is conveniently in the form of a stainless steel screw extending through a hole 28 in an arm of the T-bar. It receives a locking member in the form of a laterally elongated L-shaped clip 30 retained on the screw by a stop in the form of a locking nut 31.

The clip 30 has a base 32 provided with an internally threaded hole 33 receiving the screw 24. A downwardly depending vertical leg 34 extends generally parallel to the upstanding leg 16 of the T-bar and laterally a sufficient distance to bear against the leg to provide a stop to rotation when the screw 24 is turned. The screw 24 and clip 30 are closely spaced to the leg 16 of the T-bar to provide this relationship. The stop in the form of the nut or locking cap nut 31 limits the upward movement of the clip to limit it from moving beyond bearing relation with the leg 16 of the T-bar.

The clip 30 is designed to be raised or lowered with the turning of the screw 24 by application of a screwdriver to the head 22 of the screw. The head 22 may be provided with a Phillips or slotted head as desired. The turning of the screw 24 engages or disengages the clip with the ceiling panel as will be further described.

USE

The sealing system of this invention is very simply installed and used. The foam strip by virtue of the one sided adhesive is simply laid upon the arms 18 and 20 of the T-bar.

The locking device comprising the operating rod 24 and the clip 30 is then fitted upon the T-bar panel by inserting the screw 24 through the unthreaded receiving hole 28 in the arm 20 of the T-bar. The screw 24 is then screwed into the clip 30 followed by screwing on the cap nut 31.

The sealing system is ready for installation of the ceiling panels by turning the screw 24 to raise the clip 30 to the top position shown in FIG. 1. This permits a wide open position facilitating the insertion of the ceiling panel 12 between the clamping clip 30 and the arm 20 of the T-bar upon which the panel rests.

After the insertion of the ceiling panel, the screw 24 is rotated clockwise to cause the clip 30 to ride down and clamp against the edge of the ceiling panel and bear against the foam strip 26 to effect a tight sealing action. In this position the locked panel resists forces which might tend to lift it from the T-bar such as by hosing or spraying cleaning solution against or by other pressures that might be applied against it. In the rotation of the operating rod or screw 30, the clip is prevented from turning by bearing against the upstanding leg 16 of the T-bar.

Figure 5:
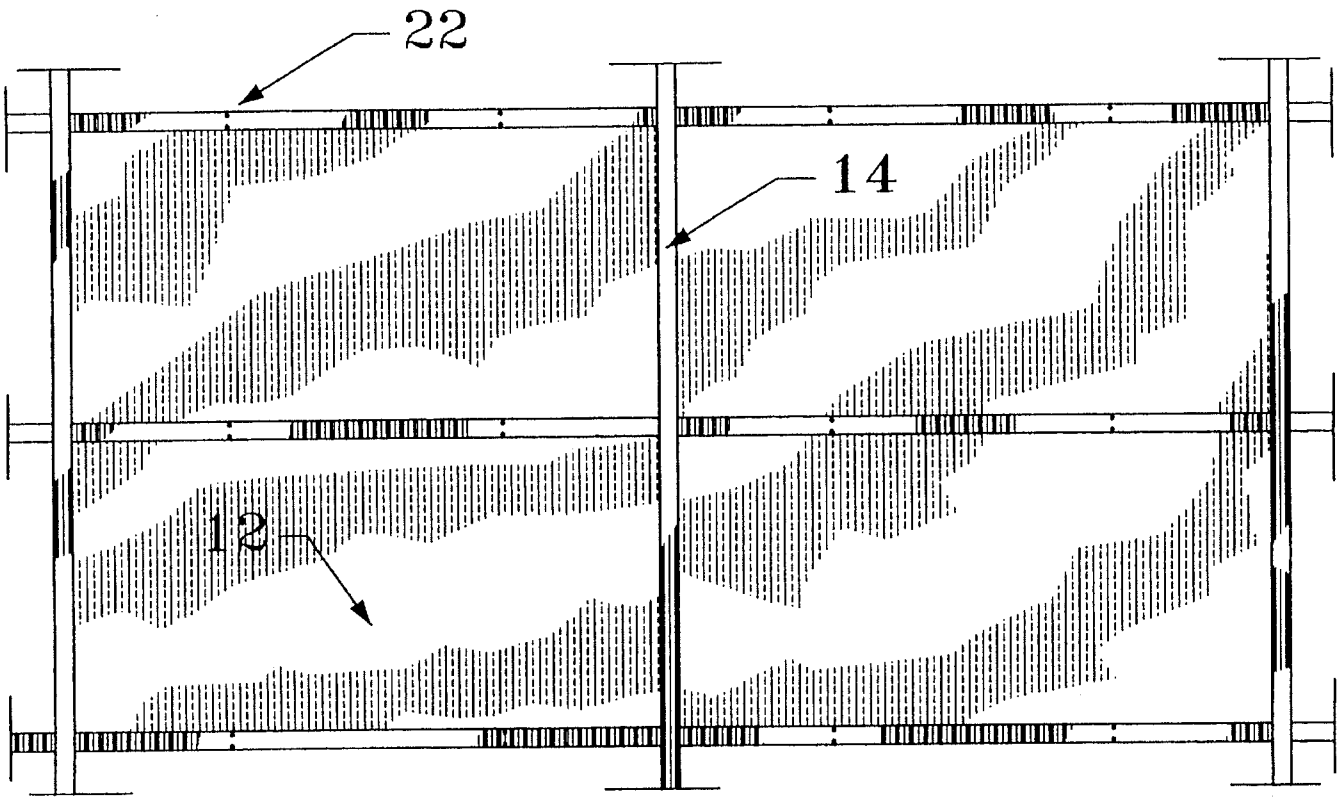
FIG. 5 is a schematic bottom plan view of a panel ceiling grid provided with the sealing system.

The finished installation employing a pair of locking members on each side of a panel is shown in FIG. 5 using two feet by two feet ceiling panels 12. Should longer panels, such as two foot by four feet be employed, additional lock members may be employed at the sides and ends as will be well understood.

When the ceiling panels are desired to be removed for replacement, inspection of the area above the panels or for any other reason, the clip 30 is simply unclamped from the ceiling tile 12 by turning the screw 24 in a reverse direction to effect disengagement. The ceiling panel may then be removed. Replacement with other panels of one type or another may be effected as desired.

Various changes and modifications may be made within this invention as will be apparent to those skilled in the art. Such changes and modifications are within the scope and teaching of this invention as defined in the claims appended hereto.

What is claimed is:

1. A multi-panel ceiling system having a support grid comprised of upstanding T-bars having oppositely disposed laterally extending arms at the bottom of an upstanding leg, panels supported at a peripheral edge upon said legs and sealing means for sealing said edges upon said arms, said sealing means comprising operating means for locking and unlocking said sealing means, said operating means comprising an elongated operating rod extending through an arm of said T-bar and having a lower end accessible from underneath the T-bar and an upper portion engageable with a locking member, said locking member being engageable with an edge portion of a panel to provide a downward thrust against a peripheral edge of said panel to seal said edge against said arm and said locking member being disengageable by operation of said operating rod to disengage said locking member from said panel in order that the panel may be removed from the T-bar.

2. The ceiling system of claim 1 in which said operating rod is in the form of a screw having on the lower end a head rotable by a hand tool, said screw extending upwardly through a threaded hole in said locking member.

3. The ceiling system of claim 2 in which a stop is provided on a free end of said screw to limit upward movement of said locking member beyond the upstanding leg of the T-bar.

4. The ceiling system of claim 2 in which said locking member has a threaded opening receiving said operating rod and is moveable up and down by rotating the operating rod.

5. The ceiling system of claim 4 in which said locking member has opposite ends which are caused to bear against the leg of the T-bar to stop rotary movement of the locking member and effect vertical movement thereby when the operating rod is rotated.

6. The ceiling system of claim 5 in which the locking member is in the form of an L-shaped clip having a base provided with said threaded opening and a vertical leg positioned closely to and extending generally alongside the leg of the T-bar.

7. The ceiling system of claim 1 in which foam members are provided on arms of the T-bars underneath peripheral edges of the ceiling panels to provide a seal between the panels and the T-bar arms.

8. The ceiling system of claim 4 in which said locking member has opposite ends which are caused to bear against the leg of the T-bar to stop rotary movement of the locking member and effect vertical movement thereby when the operating rod is rotated and a stop is provided on a free end of said screw to limit upward movement of said locking member beyond the upstanding leg of the T-bar.

9. The ceiling system of claim 4 in which said locking member has opposite ends which are caused to bear against the leg of the T-bar to stop rotary movement of the locking member and effect vertical movement thereby when the operating rod is rotated and foam members are provided on arms of the T-bars underneath peripheral edges of the ceiling panels to provide a seal between the panels and the T-bar arms .

10. The ceiling system of claim 4 in which the locking member is in the form of an L-shaped clip having a base provided with said threaded opening and a vertical leg extending generally parallel to the leg of the T-bar, a stop is provided on a free end of said screw to limit upward movement of said locking member beyond the upstanding leg of the T-bar and foam members are provided on arms of the T-bars underneath peripheral edges of the ceiling panels to provide a seal between the panels and the T-bar arms.

11. The ceiling system of claim 3 in which said stop is a nut positioned on the screw substantially even with the top of the T-bar leg.

* * * * *